United States Patent [19]

Gaston

[11] Patent Number: 4,748,758

[45] Date of Patent: Jun. 7, 1988

[54] INDEX CARD AND TYPING AND PRINTING SYSTEM THEREFOR

[76] Inventor: Elizabeth Andros Gaston, 1101 Woodcliff St., Alexandria, Va. 22308

[21] Appl. No.: 832,789

[22] Filed: Feb. 26, 1986

[51] Int. Cl.[4] ..... B42F 21/00

[52] U.S. Cl. ..... 40/359; 400/522; 400/535

[58] Field of Search ..... 400/523, 525, 521, 522, 400/535; 402/79; 283/61; 40/359, 124.1; D19/1

[56] References Cited

U.S. PATENT DOCUMENTS 3,970,397 7/1976 Armstrong ..... 40/360
4,560,600 12/1985 Yellin et al. ..... 40/360

FOREIGN PATENT DOCUMENTS 39979 3/1982 Japan ..... 400/522
7589 of 1900 United Kingdom ..... 400/521

*Primary Examiner*—Robert Peshock
*Assistant Examiner*—Cary E. Stone
*Attorney, Agent, or Firm*—Jim Zegeer

[57] ABSTRACT

An index card having a predetermined size has at least two typewriter or printer retaining borders which are joined to the index card on intersecting edges of the typing or printing area of the index card by perforated lines or score lines so that after the index card has been typed, the typewriter or printer retaining borders can be easily detached to result in a standard 3"×5" card, for example. The typewriter or printer retaining borders retain the typing or printing area in proper position when typing or printing at the "bottom" of the typing or printing area of the index card.

12 Claims, 1 Drawing Sheet

INDEX CARD AND TYPING AND PRINTING SYSTEM THEREFOR

This invention relates index cards and typing and printing systems therefor.

Three-by-five (3"×5") index cards (which are relatively stiff paper) are widely used in the office and home, and elsewhere. When these cards are fed through a typewriter or printer, and the bottom of the card is reached, the card slips and slides in the machine resulting in skewed and uneven printing or typing on the bottom of the card.

The object of this invention is to provide an improved index card and improved typing and printing system.

This invention solves the problem by providing typewriter or printer detachable retaining borders on at least two intersecting sides of the index card. When the card with the retaining borders is in the typing or printing machine, the retaining borders remain in the last feed roller and the "bottom" of the card is securely positioned in the print or impact area of the printer or typewriter so that the full print area of the card can be utilized without slipping or sliding and skewed typing or printing. In a preferred embodiment, the retaining border or edges are formed on three sides of the index card and are joined by perforated or score lines.

BRIEF DESCRIPTION OF THE DRAWINGS

The above and other objects, advantages, and features of the invention will become more apparent when considered with the following specification and accompanying drawings wherein.

DETAILED DESCRIPTION OF THE INVENTION

Figure 1:
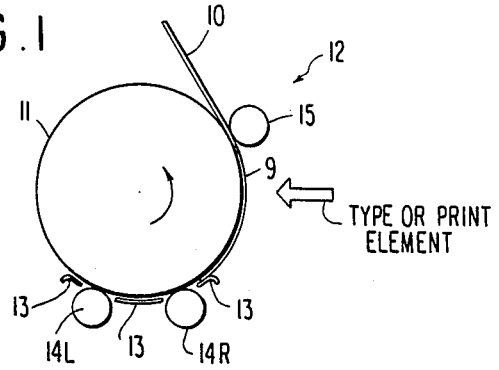
FIG. 1 is a diagrammatic side-elevational view of a conventional platen-fed roller system for a printer, impact typewriter, etc. to illustrate the invnetion.

As shown in FIG. 1, a three-by-five (3×5) index card 10 comprised of a relatively stiff paper is wound around the main roller or platen 11 of a printer or typewriter 12 drawing a curved paper guide member 13 and projecting bottom feed rollers 14 and a set of rollers 15 for positioning and securely holding the card in the machine. When the "bottom" of the card passes from between the platen roller and last feed roller set 14-R, traction on the card is lost and it can shift or move so the printing or typing is skewed or uneven on the card. This results in the loss of the card, and it frequently must be retyped for clarity and neatness, resulting in a loss of time.

When stiffer 3×5 index cards are used, the problem can be aggravated because the stiffness of the card material causes the "bottom" to spring forward just as it leaves feed roller set 14-R. Moreover, the loss of traction is, in effect, a loss of position retention in a lateral direction, resulting in further distortion of the printed or typed material.

Figure 2:
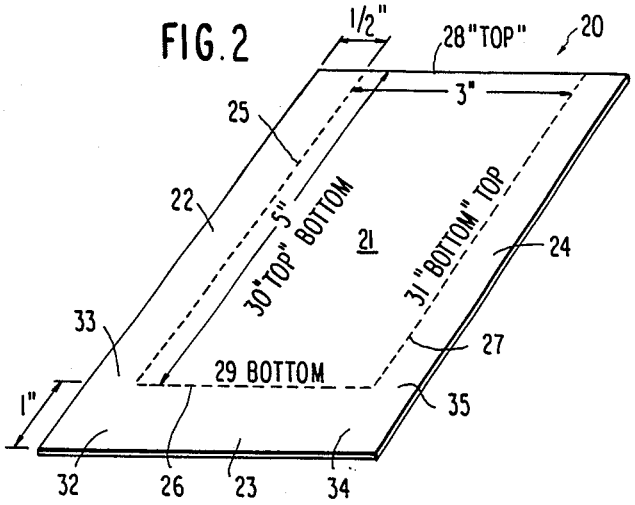
FIG. 2 is an perspective view of an index card incorporating the invention.

According to this invention, retaining borders are formed on at least two sides or edges of a 3×5 index card which are joined to the main typing or print area of the index card by scored or perforated lines. As shown in FIG. 2, a 3×5 index card 20 has a 3×5 size actual printing or typing area 21 and three retaining borders 22, 23 and 24, respectively, which are joined to printing or typing area 21 by scored or perforated lines 25, 26 and 27, respectively. The width of the retaining borders 22, 23 and 24 are at least equal to the distance from just below the impact area and the last feed roller 14-R. Typical effective dimensions are shown on FIG. 2. A minimum dimension of about ½" has been found to be most effective. The perforated or score lines can be of any type including that designated as "letter edge perfs" which leaves smooth edges.

In card 20, edge 28 is labeled "top" and edge 29 is labeled "bottom". When fed into a typewriter for example, the edge labeled "top" is fed first so as to appear in impact or print area 9. As is usual with conventional 3×5 index cards, there is no problem when typing or printing at the top in typing or printing area 21. When typing or printing at bottom 29, the bottom edge 29 in proper printing or typing position so that all of the typing or printing area 21 can be used effectively and efficiently.

If the card is fed through the machine, the edge 30 (also labeled "top") first arrives at the impact or print area 9 and is printed or typed upon. When the "bottom" edge 31 is reached, retaining border or edge 24 securely positions and retains the bottom edge 31 in proper position at impact or print area 9.

The reverse sides of the cards can be typed or printed upon in essentially the same fashion.

In each case, after all printing or typing has been done on the card, the retaining borders or edges 22, 23 and 24 are separated by tearing, ripping, folding along the respective score or perforated lines 25, 26 and 27, respectively.

Figure 3:
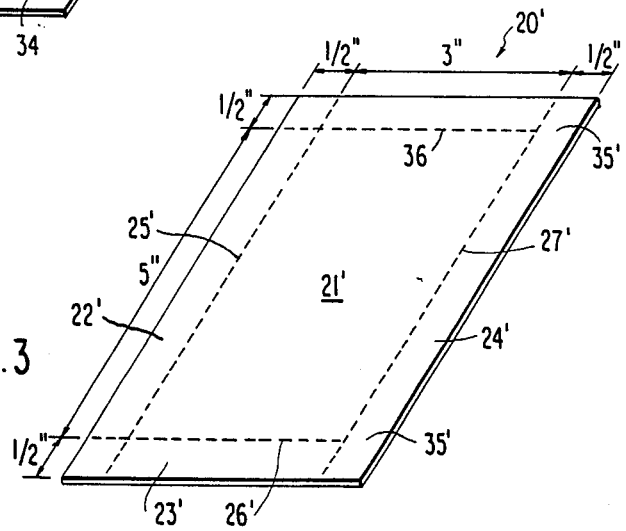
FIG. 3 is a perspective view of a modification of the invention.

In the preferred embodiment of FIG. 2, the score or perforated lines 25, 26 and 27 are not extended to the edges of the card in the areas 32, 33 and 35. This assures a smoother feeding through the machine and that none of the perforated or score line ends separate unintentionally or pematurely during use. However, as shown in FIG. 3, the score or perforated lines may extend for the full length of the index cards at both ends. In this case, a further perforated or score line 36 is provided so that the typing or printing area 21' can be centered on the full card, if desired. In this case, premature separation of the score lines can be avoided by leaving short end portions unperforated or unscored.

It will be appreciated that the major objective of the invention preventing slipping and sliding of the card when typing or printing at the "bottom" of the card has been accomplished in a highly efficient and inexpensive manner. The cards can be stored in conventional 3×5 card storage files; easily carried in the suit pockets, for example, or a purse, wallet or billfold. Both sides of the card can be used and they can be made in a variety of colors for indexing purposes or color coding. Various information can be preprinted on the card, if desired.

Various modificiations and adaptations of the invention will be readily apparent to those skilled in the art, and it is intended that such modifications and adpatations as would be obvious to one skilled in the art be encompassed by the claims appended hereto.

What is claimed is:

1. A rectangular four sided discrete index card having smooth edges on all four sides and formed of a body of relatively stiff paper for use in a typewriter or printer having spaced apart friction drive feed roller means and impact or print area means, said index card having a typing or printing area of a predetermined rectangular size, and at least a pair of typewriter or printer retaining borders on at least two intersecting sides of said typing or printing area and each said border having a width at least the distance from the impact or print area to said feed roller so that when the bottom of the index card is in said impact or print area means to be typed or printed upon, at least one of the said retaining borders is opposite said feed roller means so as to position and securely hold said typing or printing area while being typed or printed upon and avoid slipping of the index card and skewed printing, and perforated score lines adjoining each said border to said index card for manual separation along said perforated score lines and removal thereof after printing or typing on said typing or printing area whereby said index card can be selectively fed into said typewriter or printer in one of two directions relative to the length and width dimension of said card.

2. The index card defined in claim 1 wherein said retaining borders have a width of at least ½ inch.

3. The index card defined in claim 1 wherein said perforated score lines terminate short of one edge of said card to avoid premature separation of said retaining borders from said typing or printing area.

4. The index card defined in claim 1 wherein said retaining borders are on three sides of said card and said perforated score lines extend only on the edges of said typing or printing area.

5. The index card defined in claim 1 wherein there is a retaining border on each edge of said typing or printing area and each said perforated score line extends from edge to edge of said index card.

6. A method of typing or printing on 3"×5" index cards in a typewriter or printer having a main roller feed roller means or impact or print roller means comprising, forming at least a pair of ½ inches wide or greater retaining edges on at least two of the adjoining edges of said 3"×5" index card, said retaining edges being joined to two intersecting edges, respectively, of said 3"×5" index card, by perforation or score lines, so that there is at least one said retaining edge on the short 3" side of said index card and at least one said retaining edge on the longer 5" side of said index card, selectively feeding said index card into said typewriter or printer such that it moves therethrough in a direction (1) parallel to the longer 5" side of said index card or (2) parallel to the short 3" side of the said index card, retaining the bottom of said 3"×5" indx card in said impact or print area means area of said typewriter or printer, when fed in either of said directions, by selectively positioning one of said retaining borders between said main roller and the last set of feed rollers of said typewriter or printer and typing and printing on said bottom while retained in position by a selected one of said retaining borders, removing the card from said typewiter or printer, and detaching each of said retaining borders from said 3"×5" index card by manually separating along said perforations or score lines.

7. The method of typing or printing on 3"×5" index cards as defined in claim 6 and, prior to the step of detaching each of said retaining borders, typing or printing on the reverse side of said 3"×5" index card, and retaining the bottom of said 3"×5" index card in the print or impact area of said typewriter or printer by selectively positioning one of said retaining borders between said platen and last set of feed rollers while printing on said reverse side of said 3"×5" index card.

8. A rectangular four sided discrete index card for use in a typewriter or printer having a friction drive feed roller and a print or impact area, said index card being formed of a body of relatively stiff paper of a predetermined color and having a typing are of about 3"×5" on both sides thereof, and at least a pair of retaining borders on at least two intersecting sides of said typing area and each said retaining border having a width of at least the distance from the impact area to the last feed roller so that when the bottom of the index card is in said impact area to be typed upon, at least one of the said retaining borders is opposite said feed roller so as to position and securely hold said print area in said impact area while being typed upon and avoid slipping of the index card in said impact area, and perforated score lines joining each said retaining border to said index card for manual separation and removal thereof after selectively typing in said typing area on at least a selected one of said sides, whereby said index card can be selectively fed into said typewriter or printer (1) in a direction parallel to said 3" side of said printing area and be retained in position for typing or printing at one bottom of said card by one of said retaining borders or (2) in a direction parallel to the said 5" side of said printing area and retained in position for typing or printing on another bottom of said card while being retained in position by another of said retaining borders.

9. The index card defined in claim 8 wherein said retaining borders has a width of at least ½ inch.

10. The index card defined in claim 8 wherein said perforated score lines terminate short of one edge of said card to avoid premature separation of said retaining borders from said typing area.

11. The index card defined in claim 8 wherein said retaining borders are on three sides of said card and said perforated score lines extend only on the edges of said typing area.

12. The index card defined in claim 8 wherein there is a retaining border on each edge of said typing area and each said perforated score line extends from edge to edge of said index card.

* * * * *